United States Patent [19]

Chou

[11] Patent Number: 4,527,576

[45] Date of Patent: Jul. 9, 1985

[54] RETRACTABLE COMB AND BRUSH

[76] Inventor: Fargo Chou, 10-4 Fl., No. 62, Chang Chun Rd., Taipei, Taiwan

[21] Appl. No.: 608,895

[22] Filed: May 10, 1984

[51] Int. Cl.[3] ..... A45D 24/10

[52] U.S. Cl. ..... 132/123; 132/11 R; 132/85

[58] Field of Search ..... 132/123, 11 R, 126, 132/9, 85; 15/184, 257.05, 104.5 X; 401/122 X; 206/406

[56] References Cited

U.S. PATENT DOCUMENTS

| | | | |
|---|---|---|---|
| 2,244,068 | 6/1941 | Kay | 132/11 R |
| 3,019,463 | 2/1962 | Mitchell | 132/11 R |
| 3,150,393 | 9/1964 | Taylor et al. | 132/11 R UX |
| 3,260,269 | 7/1966 | Zurndorfer | 132/123 |
| 4,001,910 | 1/1977 | Peilet | 132/9 |
| 4,118,823 | 10/1978 | Axelrod | 132/9 |
| 4,226,251 | 10/1980 | Wall | 132/85 |
| 4,250,590 | 2/1981 | Chiang | 132/11 R |

*Primary Examiner*—Gregory E. McNeill

[57] ABSTRACT

A retractable comb and brush includes a casing having a perforated pad drilled with plurality of bristle holes, a bristle means fixed with plurality of bristles extendible and retractable through the bristle holes and a bristle extender raising the bristles outwards for combing use, wherein the bristles may be automatically retracted by depressing a releasing button to separate a latch normally locking a positioning gear formed on the bristle extender.

4 Claims, 7 Drawing Figures

RETRACTABLE COMB AND BRUSH

BACKGROUND OF THE INVENTION

U.S. Pat. No. 4,226,251 of Albert Wall taught a hairbrush construction having means for positively locking the bristles in either a projected or retracted position so that the bristle unit can be readily removed for cleaning or replacement by another bristle unit. However, Wall's patent still has the following defects:

1. The bristle unit 14 is resiliently backed by leaf spring 21, which will not be stable during combing or brushing operation.

2. The locking of the bristle unit should be operated by push button 17, which is quite inconvenient because the bristle unit is always backed by spring 21 and the pushing of button 17 needs much force against the upward resilient force from spring 21.

3. Whenever retracting the bristles 16 through the define openings 44, as the openings 44 are each formed as a lengthy slot, the dirts or hairs during combing action will easily poke into such openings 44 to contaminate the internal casing of the brush construction.

The present inventor has found the defects of conventional Wall's brush and invented the present retractable comb and brush.

SUMMARY OF THE INVENTION

The object of the present invention is to provide a retractable comb and brush which includes a casing having a perforated pad, a bristle means and a bristle extender, wherein the bristle extender is actuated to extend the bristles fixed on bristle means through the bristle holes formed on the perforated pad for combing use and may be retracted inside the perforated pad for easier cleaning and convenient handling or storage.

DETAILED DESCRIPTION

Figure 1:
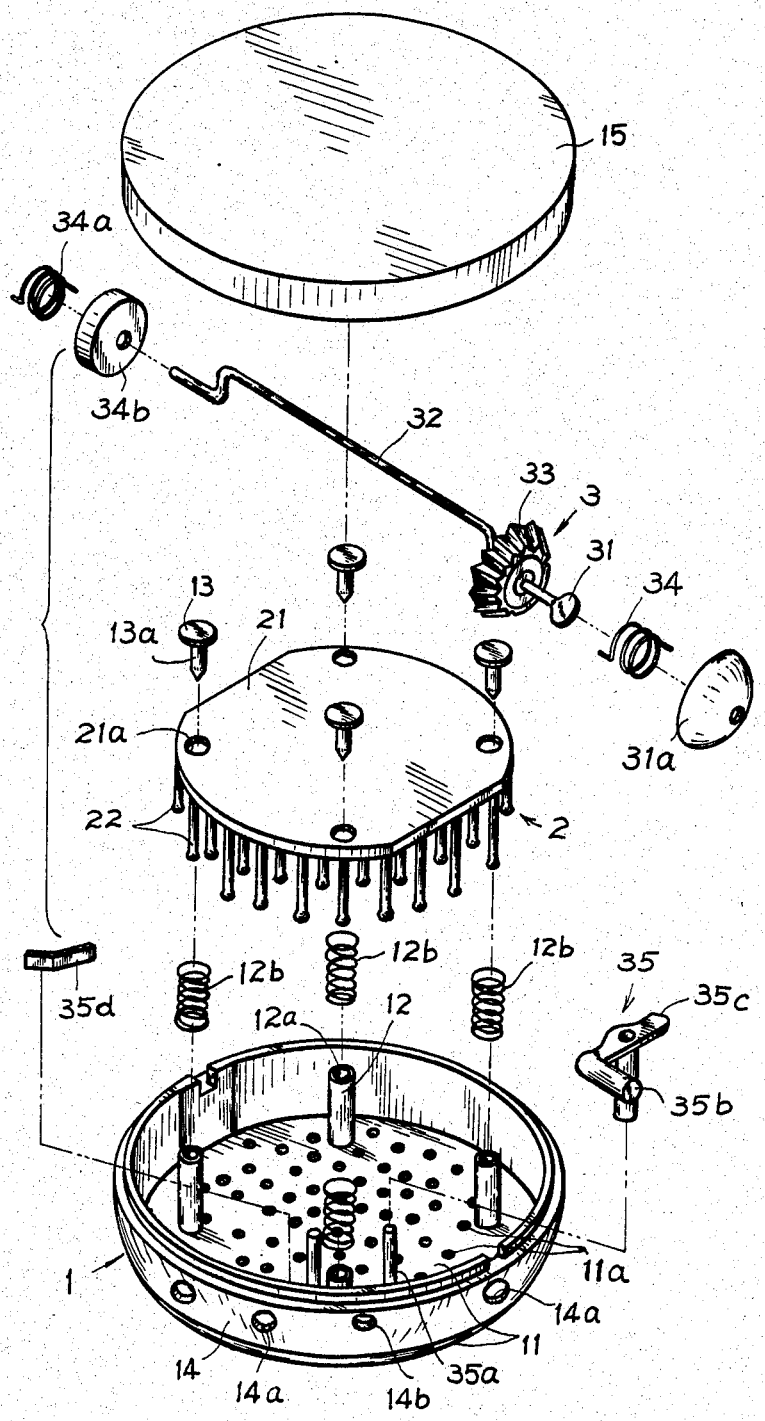
FIG. 1 is a perspective illustration showing all components in accordance with the present invention.
Figure 3:
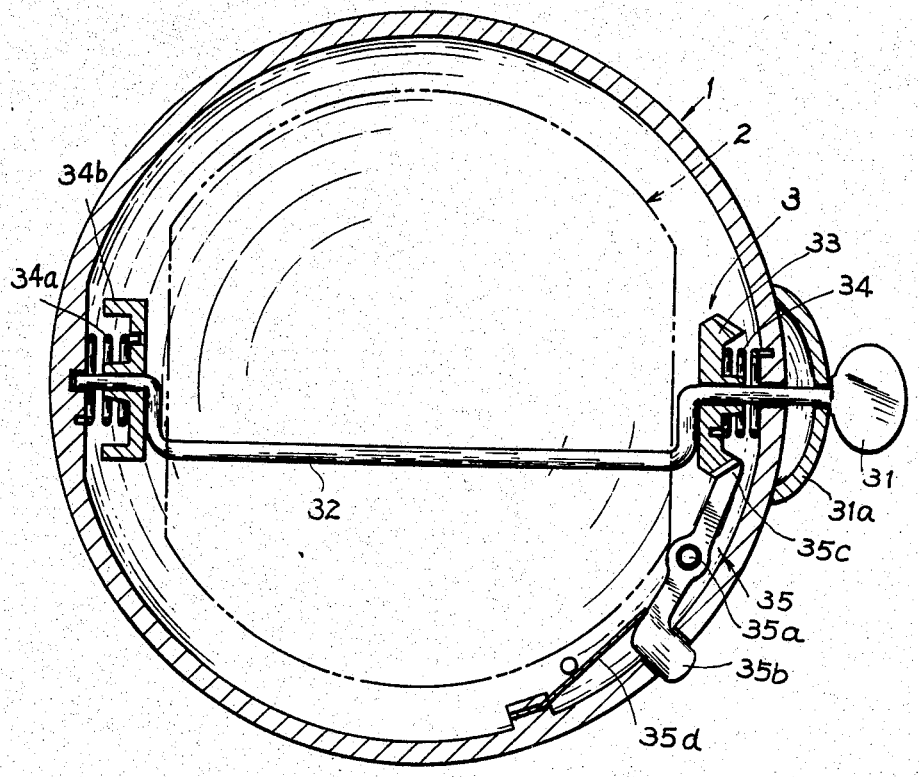
FIG. 3 is a bottom-view drawing showing the bristle extender in accordance with the present invention.
Figure 2:
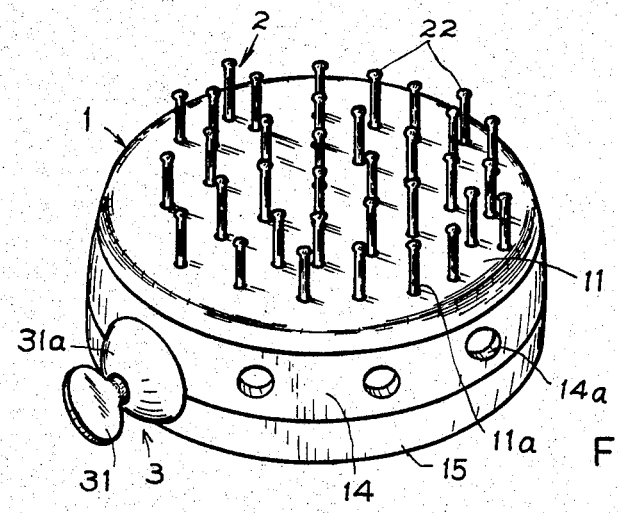
FIG. 2 is a perspective drawing of one preferred embodiment in accordance with the present invention.

As shown in FIGS. 1, 2, and 3, the present invention includes a casing 1, a bristle means 2 and a bristle extender 3.

Casing 1 comprises a perforated pad 11 drilled with plurality of bristle holes 11*a*, several bristle-extending guides 12, a cylindrical wall 14 disposed on the perforated pad 11, and a cover 15 covering cylindrical wall 14.

Bristle means 2 comprises a bristle base 21 and a plurality of bristles 22 fixed on base 21. Each bristle-extending guide 12 is formed with a pin hole 12*a* which is inserted with a pin 13*a* of a limiting cap 13. Each guide 12 is jacketed with a tension spring 12*b*. The bristle base 21 is drilled with several guide holes 21*a* each passing the bristle-extending guide 12. The bristle means 2 is then movably on the guides 12 and is resiliently backed by the springs 12*b*. The limiting caps 13 define the backward motion of bristle means 2.

Bristle extender 3 comprises a rotating knob 31, a raising arm 32 formed as U-shaped to raise bristle means 2, a positioning gear 33 connected between raising arm 32 and rotating knob 31, two retaining springs 34, 34*a* respectively disposed on both ends of raising arm 32, and a releasing means 35 which includes a pivot 35*a* for rotatably mounting releasing means 35, a releasing button 35*b* extending through a hole 14*b* formed on cylindrical wall 14, a latch 35*c* engaging with positioning gear 33, and a spring plate 35*d* resiliently biasing latch 35*c* to resiliently engage with gear 33.

Figure 4:
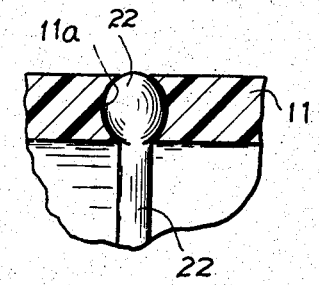
FIG. 4 is a partial illustration showing a bristle retracted into the perforated pad in accordance with the present invention.
Figure 5:
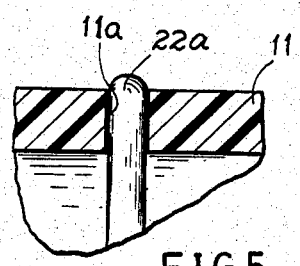
FIG. 5 shows another bristle retracted into perforated pad of the present invention.

The cylindrical wall 14 is formed with washing holes 14*a* so that the present invention may be dipped in detergent water for flushing the oil dirts possibly penetrating into casing through bristle holes 11*a*. The perforated pad 11 may be made from elastomers or rubber materials so that the bristles 22, 22*a* as shown in FIGS. 4 and 5 may be retracted into pad 11 and the elastomer material of pad 11 will serve as a packing for sound sealing and prevent dirt penetration through the holes 11*a*.

One end of retaining spring 34 is fixed on positioning gear 33 and another end thereof is fixed on the wall 14. Another retaining spring 34*a* is fixed on the wall 14 opposite to spring 34 and is also fixed on a disk 34*b* connected with raising arm 32. A washer 31*a* is provided between the rotating knob 31 and the wall 14 for smooth rotation of knob 31.

Figure 6:
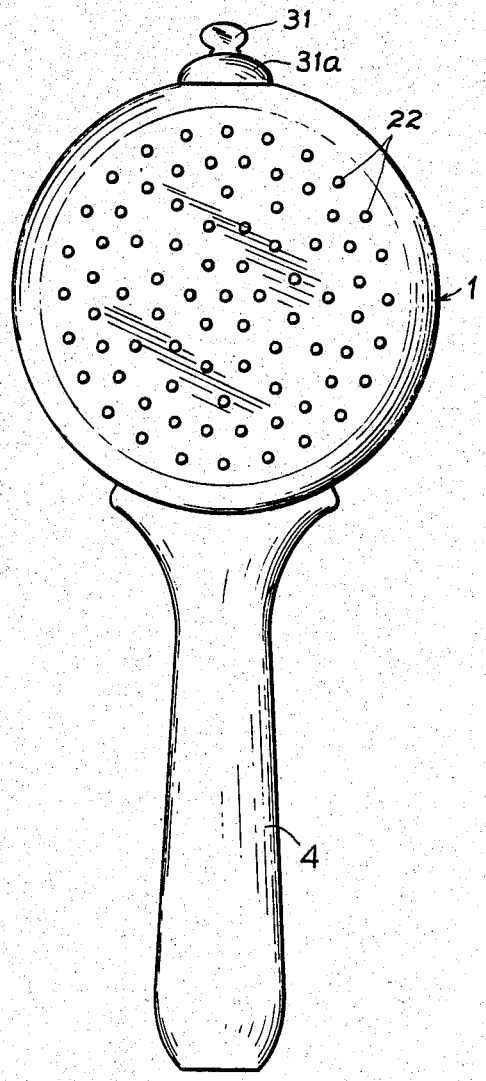
FIG. 6 is a top-view drawing of another preferred embodiment in accordance with the present invention.
Figure 7:
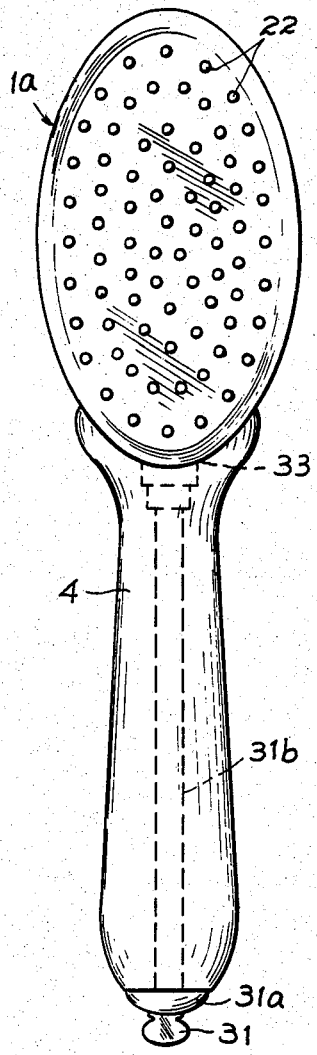
FIG. 7 is a top-view drawing of still another preferred embodiment in accordance with the present invention.

A handle 4 is connected with casing 1 as shown in FIG. 6. The raising arm 32 may be extended through a handle 4 by connecting a link 31*b* and terminated by the rotating knob 31 as FIG. 7 shown.

When using the present invention, the rotating knob 31 may be rotated to allow the raising arm 32 to push bristle means 2 upwards to extend bristles for combing use. As the positioning gear 33 is always locked by latch 35*c* or releasing means 3 so that, whenever extending the bristles 22, the bristles 22 will not be retracted and will be stable as the bristle base 21 is resiliently supported by springs 12*b*. During the rotation of knob 31, the retaining springs 34, 34*a* are wound to store the resilience. When depressing the releasing button 35*b*, the latch 35*c* is separated from the engagement with gear 33 so that gear 33 is no longer locked and the resilience of springs 34, 34*a* will re-rotate the raising arm 32 to retract the bristles 22 within perforated pad 11, whereby the dirts or hairs accumulated on bristles 22 will then be easily removed.

Accordingly, the present invention has the following advantages in comparison with the prior Wall's patent:

1. The bristles can be retracted automatically only by depressing a releasing button. The extension of bristles is merely operated by rotating knob 31 in an easier and more convenient way.

2. When not in use, the bristles can be retracted into perforated pad for compact storage or handling.

3. The pad 11 may serve as a packing to prevent penetration of dirts through the bristle holes 11*a*. Even a little amount of dirt may still come into casing, the washing hole 14*a* provides a water passage for flushing and washing purpose.

4. The bristles can be optionally positioned and automatically locked as the positioning gear 33 is normally engaged by a latch 35*c* of a releasing means 35 of the present invention.

The present invention is applied both for combs and brushes. The cover 15 may be formed as a mirror for wider uses.

I claim:

1. A retractable comb and brush comprising:

a casing having a perforated pad drilled with plurality of bristle holes thereon, several bristle-extending guides formed inside said pad and each jacketed with a tension spring, a cylindrical wall disposed on said perforated pad and a cover fixed on said cylindrical wall; a bristle means having a bristle base formed with several holes to be jacketed onto said bristle-extending guides and defined by limiting caps each inserted into pin hole of each said bristle-extending guide, and plurality of bristles fixed on said bristle base; and a bristle extender having a rotating knob, a raising arm formed as U-shaped to raise said bristle means, a positioning gear fixed between said raising arm and said rotating knob, two retaining springs of which first spring is fixed on said casing wall and on said positioning gear and second spring fixed on said wall and a disk opposite to said first spring, and a releasing means which includes a pivot for rotatably mounting said releasing means on said casing, a releasing button extending outside said casing, a latch normally engaging with said positioning gear and a spring plate resiliently biasing said latch to lock said positioning gear, whereby said knob can be rotated to raise said bristle means and when depressing said releasing button, said bristles can be automatically retracted with said perforated pad by resilience stored during rotation of said rotating knob.

2. A retractable comb and brush according to claim 1, wherein said perforated pad is made from elastomer or rubber materials.

3. A retractable comb and brush according to claim 1, wherein said cylindrical wall of said casing is formed with plurality of washing holes for flushing use.

4. A retractable comb and brush according to claim 1, wherein said raising arm is extended through a handle fixed on said casing and connected with a link which is then terminated by a rotating knob.

* * * * *